US007296950B1

(12) United States Patent
Stankus et al.

(10) Patent No.: US 7,296,950 B1
(45) **Date of Patent: *Nov. 20, 2007**

(54) POINT ANCHOR COATED MINE ROOF BOLT

(75) Inventors: John C. Stankus, Canonsburg, PA (US); John G. Oldsen, Butler, PA (US)

(73) Assignee: Jennmar Corporation, Pittsburgh, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/474,006

(22) Filed: Jun. 23, 2006

Related U.S. Application Data

(63) Continuation-in-part of application No. 11/232,163, filed on Sep. 21, 2005, now Pat. No. 7,073,982.

(60) Provisional application No. 60/613,150, filed on Sep. 24, 2004.

(51) Int. Cl.
*E21D 20/02* (2006.01)

(52) U.S. Cl. ..... 405/259.6; 405/259.5; 405/259.4; 405/302.1

(58) Field of Classification Search ..... 405/259.1, 405/259.4, 259.5, 259.6, 302.1
See application file for complete search history.

(56) References Cited

U.S. PATENT DOCUMENTS

| | | | | |
|---|---|---|---|---|
| 3,805,533 | A | 4/1974 | Askey et al. | |
| 4,419,805 | A | 12/1983 | Calandra, Jr. | |
| 4,865,489 | A | 9/1989 | Stankus et al. | |
| 5,064,311 | A | 11/1991 | Giroux et al. | |
| 5,064,312 | A | 11/1991 | Calandra et al. | |
| 5,152,649 | A | 10/1992 | Popp | |
| 5,584,608 | A | 12/1996 | Gillespie | |
| 5,624,212 | A | 4/1997 | Gillespie | |
| 7,073,982 | B2 * | 7/2006 | Stankus et al. | 405/259.6 |
| 2005/0134104 | A1 | 6/2005 | Simmons et al. | |

* cited by examiner

*Primary Examiner*—Frederick L. Lagman
(74) *Attorney, Agent, or Firm*—The Webb Law Firm

(57) ABSTRACT

A resin bonded mine roof bolt having an elongated rod with a first end and a second end. A segmented resin compression layer covers a portion of the rod below the first end. When installed in a mine roof bore hole with curable resin, the resin compression layer mixes the resin and partially fills the bore hole to minimize the amount of resin needed to anchor the bolt. Individual segments of the layer are tapered to create a wedging force on resin with the bore hole.

20 Claims, 10 Drawing Sheets

POINT ANCHOR COATED MINE ROOF BOLT

CROSS REFERENCE TO RELATED APPLICATIONS

This application is a continuation-in-part application claiming priority to U.S. patent application Ser. No. 11/232,163, now U.S. Pat. No. 7,073,982, entitled "Point Anchor Coated Mine Roof Bolt," filed Sep. 21, 2005, which is incorporated herein by reference in its entirety, claiming priority to U.S. Provisional Application No. 60/613,150 entitled "Point Anchor Resin Bolt" filed Sep. 24, 2004.

BACKGROUND OF THE INVENTION

1. Field of the Invention

The present invention relates to a mine roof bolt anchored in a bore hole by mechanical anchoring, resin bonding, or both and more particularly to a mine roof bolt bearing a segmented resin compression layer that exerts a compressive force on resin within a bore hole.

2. Description of Related Art

The roof of a mine conventionally is supported by tensioning the roof with 4 to 6 feet long steel bolts inserted into bore holes drilled in the mine roof that reinforce the unsupported rock formation above the mine roof. The end of the mine roof bolt may be anchored mechanically to the rock formation by engagement of an expansion assembly on the end of the mine roof bolt with the rock formation. Alternatively, the mine roof bolt may be adhesively bonded to the rock formation with a resin bonding material inserted into the bore hole. Alternatively, a combination of mechanical anchoring and resin bonding can be employed by using both an expansion assembly and resin bonding material.

A mechanically anchored mine roof bolt typically includes an expansion assembly threaded onto one end of the bolt shaft and a drive head for rotating the bolt. A mine roof plate is positioned between the drive head and the mine roof surface. The expansion assembly generally includes a multi-prong shell supported by a threaded ring and a plug threaded onto the end of the bolt. When the prongs of the shell engage with rock surrounding a bore hole, and the bolt is rotated about its longitudinal axis, the plug threads downwardly on the shaft to expand the shell into tight engagement with the rock thereby placing the bolt in tension between the expansion assembly and the mine roof surface.

When resin bonding material is used, it penetrates the surrounding rock formation to adhesively unite the rock strata and to firmly hold the roof bolt within the bore hole. Resin is typically inserted into the mine roof bore hole in the form of a two component plastic cartridge having one component containing a curable resin composition and another component containing a curing agent (catalyst). The two component resin cartridge is inserted into the blind end of the bore hole and the mine roof bolt is inserted into the bore hole such that the end of the mine roof bolt ruptures the two component resin cartridge. Upon rotation of the mine roof bolt about its longitudinal axis, the compartments within the resin cartridge are shredded and the components are mixed. The resin mixture fills the annular area between the bore hole wall and the shaft of the mine roof bolt. The mixed resin cures and binds the mine roof bolt to the surrounding rock. The typical diameter of a mine roof bore hole is one inch. Mine roof bolts anchored with resin bonding are often ¾ inch in diameter, and more recently ⅝ inch in diameter. The mine roof bolt is generally centered within the bore hole creating a circular annulus that becomes filled with bonding resin. The larger diameter bolts (¾ inch) offer performance advantages over ⅝ inch bolts in that the annulus provided between the bore hole wall and a ¾ inch bolt is smaller than that of smaller diameter bolts. A smaller annulus provided between the bolt and the bore hole wall improves mixing of the resin and catalyst in the annulus. In addition, when the resin cartridge is shredded upon insertion of the mine roof bolt and rotation thereof in an annulus larger than ⅛ inch (as for mine roof bolts having less than ¾ inch diameter installed in one inch bore holes), the shredded cartridge can interfere with the resin and catalyst mixing. Poor mixing results in an inferior cured resin and results in poor bond strength between the bolt and bore hole wall. This phenomenon of "glove fingering" occurs when the plastic film that forms the cartridge lodges in the bore hole proximate the surrounding rock thereby interrupting the mechanical interlock desired between the resin and bore hole wall. In addition, the larger annulus created by using a ⅝ inch bolt in a one inch bore hole requires more resin to bond the bolt to the rock than does a larger diameter bolt, thereby adding to the cost of installing a smaller diameter bolt. While one solution would be to proportionally reduce the size of the bore hole to less than one inch, this is not practicable. The mine roof drilling equipment in use is conventionally produced for drilling one inch bore holes. Moreover, there are significant technical difficulties in drilling small diameter bore holes in mine roofs.

Despite these drawbacks of using mine roof bolts having a diameter of less than ¾ inch, the popularity of smaller diameter mine roof bolts is increasing. A ⅝ inch bolt is lighter and easier to use than a ¾ inch bolt and can be produced at lower cost. One solution for overcoming the need for extra resin and avoiding the glove fingering problem of smaller diameter bolts installed in one inch bore holes has been provided in a proposed mining bolt which includes an elongated rod that forms the main structure of the mine roof bolt as disclosed in U.S. Patent Application Publication No. 2005/0134104. A portion of the rod in between a drive head and the end of the bolt is coated with a layer of material having a lower specific gravity than the rod, such as a polymer. The polymeric coating layer may have external texturing which can help with mixing of resin in the mine roof bore hole. The coating on the mine roof bolt also helps to fill some of the annulus at a minimal increase in weight to the bolt and minimizes the amount of resin that is required for bonding the bolt to rock strata. This coated mine roof bolt can be produced from a ⅝ inch metal rod with a polymeric coating layer about 1/16 inch thick. The coated mine roof bolt uses only resin bonding to anchor the mine roof bolt to a rock formation.

However, the combination of both mechanical anchoring and resin bonding of mine roof bolts has been found to provide superior mine roof control. A mine roof bolt having an expansion assembly with expansion shell and plug is held against the surface of a mine roof by a plate. Rotation of the bolt mixes the resin components and expands the expansion shell. The resin mixture surrounds the expansion assembly and several feet of the mine roof bolt. Upon hardening of the resin mixture, the bolt is anchored to the rock strata by the resin and the expansion assembly. In some mine roof bolts that are anchored by a combination of resin bonding and expansion assembly anchoring, a device is used to delay relative rotation between the expansion assembly and the mine roof bolt until the resin is hardened so that the bolt can be tensioned after the resin begins to harden. An anti-rotation device prevents relative rotation between the plug of an expansion assembly and the bolt so that the plug does not thread down the bolt during mixing of the resin components. One suitable anti-rotation device is a shear pin extending through the plug. The resin components are thoroughly mixed before the shell of the expansion assembly is expanded. The end of the bolt abuts the pin to prevent initial downward movement of the plug on the bolt during rotation of the bolt to effect mixing of the resin components. Once the resin begins to set, the force on the shear pin exceeds its strength and continued rotation of the bolt shears through the pin and allows the plug to advance downwardly on the bolt to expand the shell of the expansion assembly outwardly to grip the bore hole wall.

For mine roof bolts that are anchored using a combination of a mechanical anchor and resin bonding and for coated mining bolts that are anchored with resin, the resin is desirably maintained in an upper region of the bore hole. However, retention of the resin adjacent the upper portion of the mine roof bolt is problematic. One solution has been to include a resin retaining washer at a position intermediate the end of the mine roof bolt and the mine roof for restricting the annular area in which the resin may flow. The upward thrust of a mine roof bolt bearing a resin retaining washer can exert a hydraulic force on the resin to confine it within the restricted annular area at the end of the mine roof bolt and forcibly drive the resin into the cracks and crevices on the inside of the bore hole and into the surrounding rock formation to more solidly lock the mine roof bolt within the rock formation. However, such resin retaining washers are limited in their ability to block resin from flowing downwardly along the bolt. While a resin retaining washer can withstand the hydraulic pressure created when the mine roof bolt shreds the resin capsule, nothing on the mine roof bolt urges the resin back upwardly into the bore hole.

Accordingly, a need remains for a mine roof bolt which utilizes mechanical anchoring or resin bonding, or both, to anchor the mine roof bolt in a bore hole (particularly for a small diameter mine roof bolt such as ⅝ inch) where the resin mixing and distribution is controlled by the bolt.

SUMMARY OF THE INVENTION

This need is met by the mine roof bolt of the present invention which includes an elongated rod having a first end and a second end. A segmented resin compression layer covers at least a portion of the elongated rod between the first end and the second end. The segmented layer includes a plurality of tapered segments with each segment having a first portion that is thicker than a second portion. Each segment also includes an exterior thread that is discontinuous with the thread of an adjacent segment. The surface of each segment may be textured such as by a plurality of ridges extending between the first and second portions. The mine roof bolt may also include an expansion assembly composed of an expansion shell and plug threaded onto the first end, which would be threaded as well. The segmented layer may further include a tapered portion that extends and tapers from a first portion of a terminal segment in closest proximity to the first end to a position spaced therefrom. The mine roof bolt may additionally include a resin retaining ring adjacent the end of the segmented layer that is closest to the second end. The elongated member may be a smooth bar or a textured bar such as rebar. The segmented resin compression layer may be produced from a polymeric material.

When the mine roof bolt of the present invention is installed in the mine roof bore hole, a frangible curable resin cartridge is inserted into the bore hole. The mine roof bolt is inserted into the bore hole and ruptures the resin cartridge. The mine roof bolt is rotated along its longitudinal axis such that the resin compression layer contributes to mixing the contents of the resin cartridge and compresses the resin between the mine roof bolt and the bore hole wall. In certain embodiments of the invention, an expansion assembly is used, where the rotation of the bolt causes the expansion assembly to engage with the bore hole wall. The expansion assembly may include a delay mechanism for delaying the time at which the expansion assembly expands to engage with the bore hole wall. The resin compression layer includes a plurality of tapered segments, whereby a thicker portion of each segment compresses the resin within the bore hole. In addition, the surface of each segment includes a spiral thread that urges the resin toward the first end upon rotation of the mine roof bolt.

The mine roof bolt of the present invention may be produced by providing an elongated rod and applying a segmented layer to the rod intermediate a first and second end of the rod. A drive head or drive nut is attached to the second end of the rod. In particular embodiments, an expansion assembly is threaded onto the first end. The segmented layer may be polymeric and may be applied to the rod by injection molding.

DETAILED DESCRIPTION OF THE INVENTION

Figure 1:
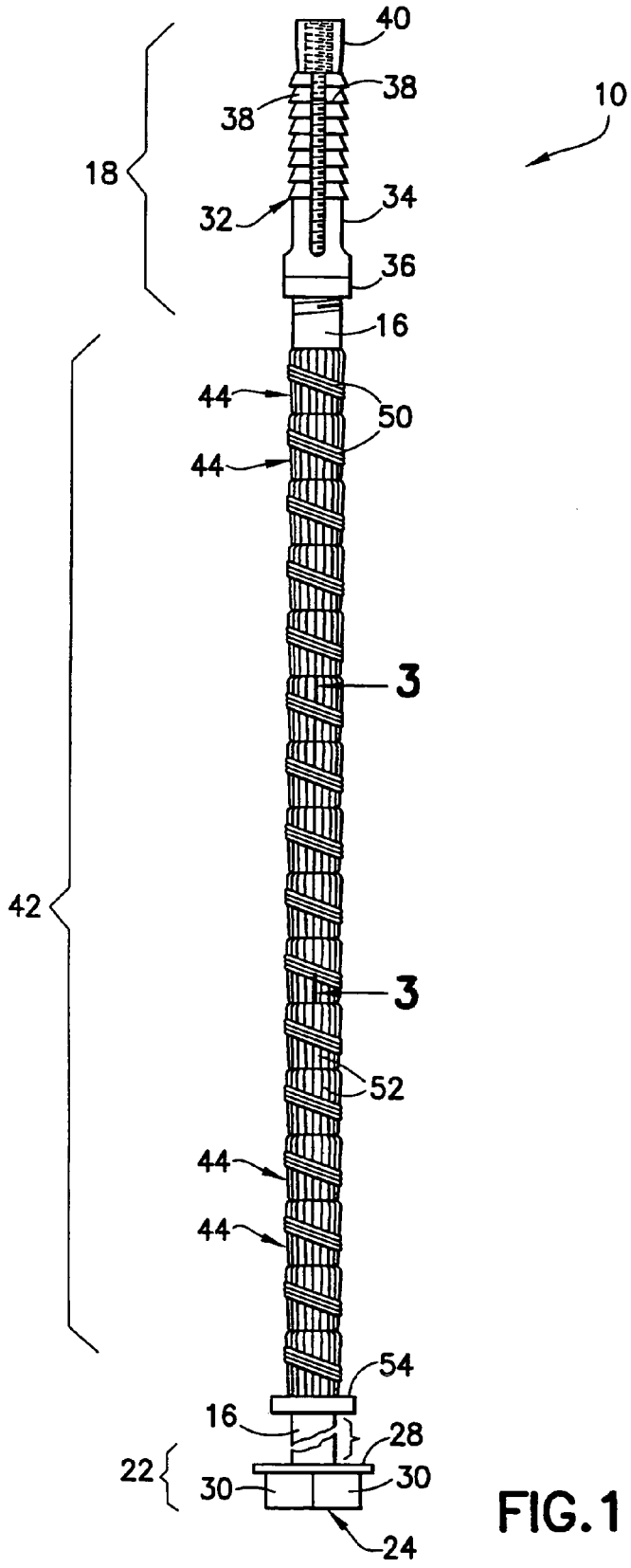
FIG. 1 is a side elevational view of a mine roof bolt having a segmented resin compression layer of the present invention, an expansion assembly, a resin retaining ring and a drive head.

A complete understanding of the present invention will be obtained from the following description taken in connection with the accompanying drawing figures, wherein like reference characters identify like parts throughout.

For the purposes of the description hereinafter, the terms "upper", "lower", "right", "left", "vertical", "horizontal", "top", "bottom" and derivatives thereof relate to the invention as it is oriented in the drawing figures. However, it is to be understood that the invention may assume alternative variations and step sequences, except where expressly specified to the contrary. It is also to be understood that the specific devices and processes illustrated in the attached drawings and described in the following specification are exemplary embodiments of the invention. Specific dimensions and other physical characteristics related to the embodiments disclosed herein are not considered to be limiting.

Figure 2:
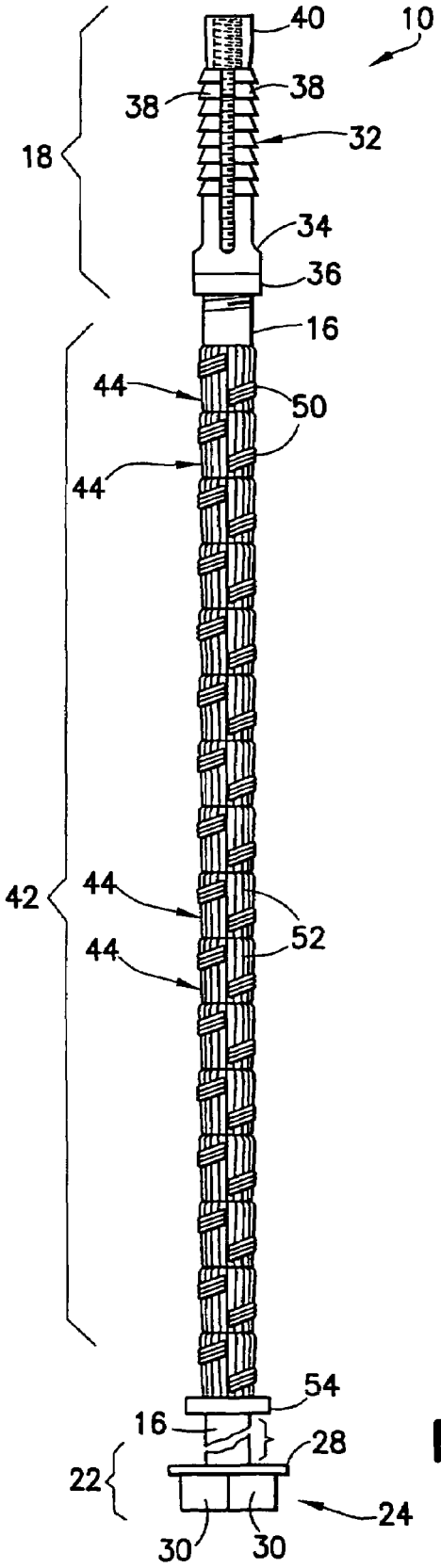
FIG. 2 is a side elevational view of the mine roof bolt of FIG. 1, from an opposing side thereof.
Figure 3:
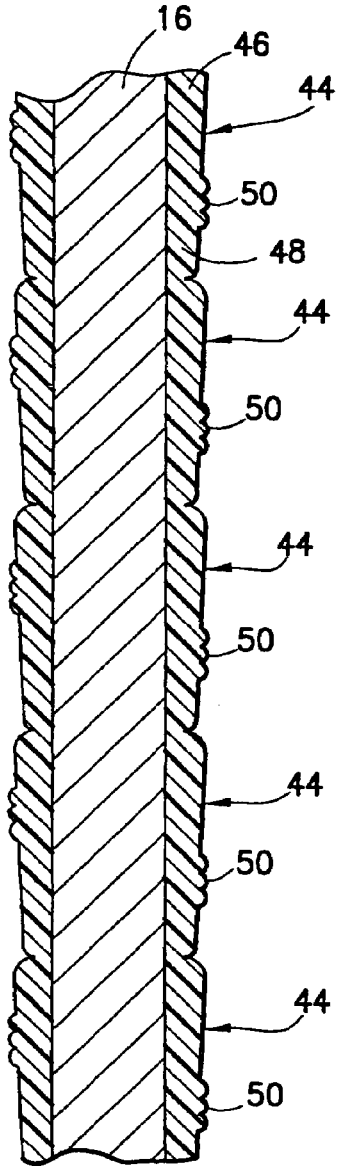
FIG. 3 is a cross section of the mine roof bolt of FIG. 1 taken along lines 3-3.

Referring to the drawings and particularly to FIGS. 1-3, there is illustrated a mine roof bolt 10 for securing in a bore hole 12 drilled in a rock formation 14 to support the rock formation 14 that overlies an underground excavation such as a mine passageway or the like. The bore hole 12 is drilled to a pre-selected depth into the rock formation 14 as determined by the load bearing properties to be provided by the mine roof bolt 10.

As shown in FIGS. 1-3, the bolt 10 includes an elongated rod 16 having a threaded end 18 for positioning in the upper blind end 20 of the bore hole 12 and a drive end 22 having a drive head 24 that extends into the mine passageway from the open end of the bore hole 12. A roof or bearing plate 26 is retained by the drive head 24 on the end 22 of the bolt 10. The drive head 24 generally includes a shoulder 28 and a plurality of drive faces 30. The rod 16, roof plate 26 and drive head 24 typically are produced from steel. An expansion assembly 32 is threaded onto the threaded end 18 of the bolt 10. The expansion assembly 32 shown in FIGS. 1-3 includes an expansion shell 34 having a base portion 36 in the configuration of a ring or collar to which are integrally attached a plurality of upwardly extending expansion leaves 38 that are spaced from one another and having free ends. A tapered plug 40 is threaded on the rod 16 into the inside of the expansion shell 34. The tapered plug 40 is configured to move downwardly toward the base 36 of the expansion shell 34 upon rotation of the bolt 10 while the expansion leaves 38 bend outwardly into gripping engagement with the rock formation 14. Other expansion shell assemblies that may be used in the present invention include bail type shells in which two expansion leaves are supported by a bail that extends over the end of the mine roof bolt and prevents expansion of the leaves from moving axially relative to the bolt until desired. In addition, the expansion assembly 32 may include a stop mechanism (not shown) such as disclosed in U.S. Pat. No. 4,419,805 to Calandra, Jr., incorporated herein by reference. An expansion shell assembly having a stop device prevents expansion of the shell assembly during the stage of mixing resin with the bolt. When the torque applied to the bolt exceeds a pre-determined torque as determined by the time for mixing the bonding material, the stop device fractures and the expansion shell assembly is then free to expand into gripping engagement with the wall of the bore hole as the plug is threaded downwardly on the bolt. In any of these expansion shell assemblies, the bolt 10 is both mechanically anchored and adhesively bonded in the bore hole to prevent slippage of the expansion assembly 32 so that the bolt remains tensioned to support the rock formation 14.

A portion of the elongated rod 16 between the threaded end 18 and the drive end 22 is covered with a resin compression layer 42. The elongated rod 16 may be a smooth rod or a textured rod such as rebar, with a smooth rod being shown in the drawings herein. In one embodiment of the invention, the resin compression layer 42 extends from a position about one inch from the lower end of the expansion assembly 32 for about sixteen to twenty inches down the length of a four foot mine roof bolt 10. Other lengths of the resin compression layer 42 may be selected relative to the length of the bolt 10, depending on the roof anchoring needs.

The resin compression layer 42 includes a plurality of tapered segments 44. Each tapered segment has a first portion 46 that is thicker than a second portion 48 as shown in FIG. 3. The tapered segments 44 create a mechanical wedging force when load is applied to the bolt 10. The surface of segment 44 includes a spiral thread 50, each spiral thread 50 of a segment 44 being discontinuous with the thread 50 of an adjacent segment 44. The spiral threads 50 may be ribbed as shown (FIG. 3) or may be smooth. The spiral threads 50 of the tapered segments 44 urge resin upwardly into the bore hole 12 upon rotation of the bolt 10 during mixing of resin. The tapered segments 44 may also include texturing such as a plurality of ridges 52 that extend between the first and second portions 46, 48. The texturing further assists in mixing and distributing the resin around the mine roof bolt 10.

Figure 4:
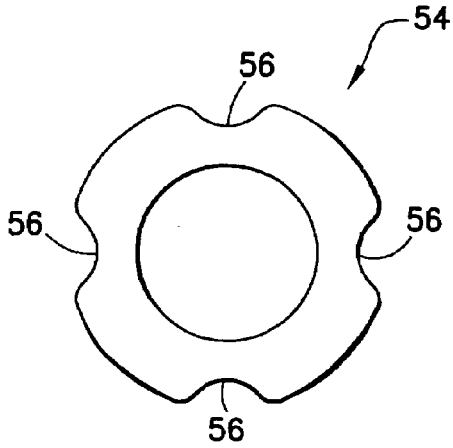
FIG. 4 is a plan view of the resin retaining ring shown in FIG. 1.

Referring to FIG. 4, a resin retaining ring 54 may also be used for maintaining resin within the annulus between the bolt and the bore hole in the location of the resin compression layer 42. The resin retaining ring 54 may be generally circular shaped with recessed portions 56 that allow for adjustment of the diameter of the ring 54 when compressed within the bore hole 12.

Figure 5:
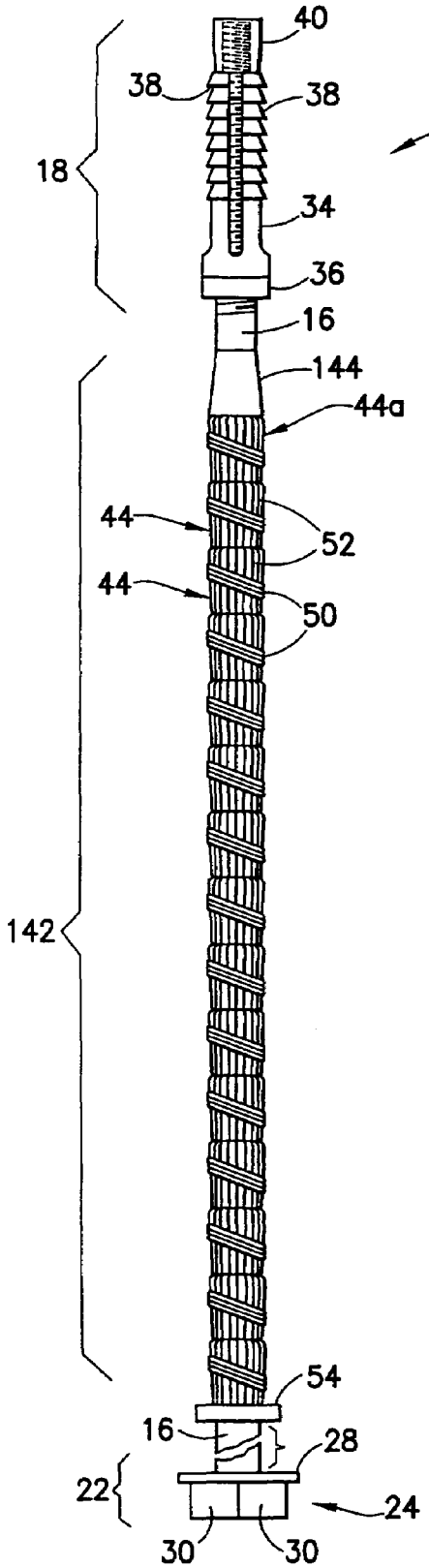
FIG. 5 is a side elevational view of a mine roof bolt wherein the segmented resin compression layer includes a terminal tapered portion.

In another embodiment of the invention shown in FIG. 5, a mine roof bolt 110 includes a resin compression layer 142 having a plurality of tapered segments 44 and a terminal tapered portion 144 that extends from a terminal segment 44*a* to a position spaced apart from the threaded end 18. This tapered portion 144 smoothes the transition between the tapered segments 44 and the elongated rod 16 and eases insertion of the bolt 110 into a bore hole.

Figure 6:
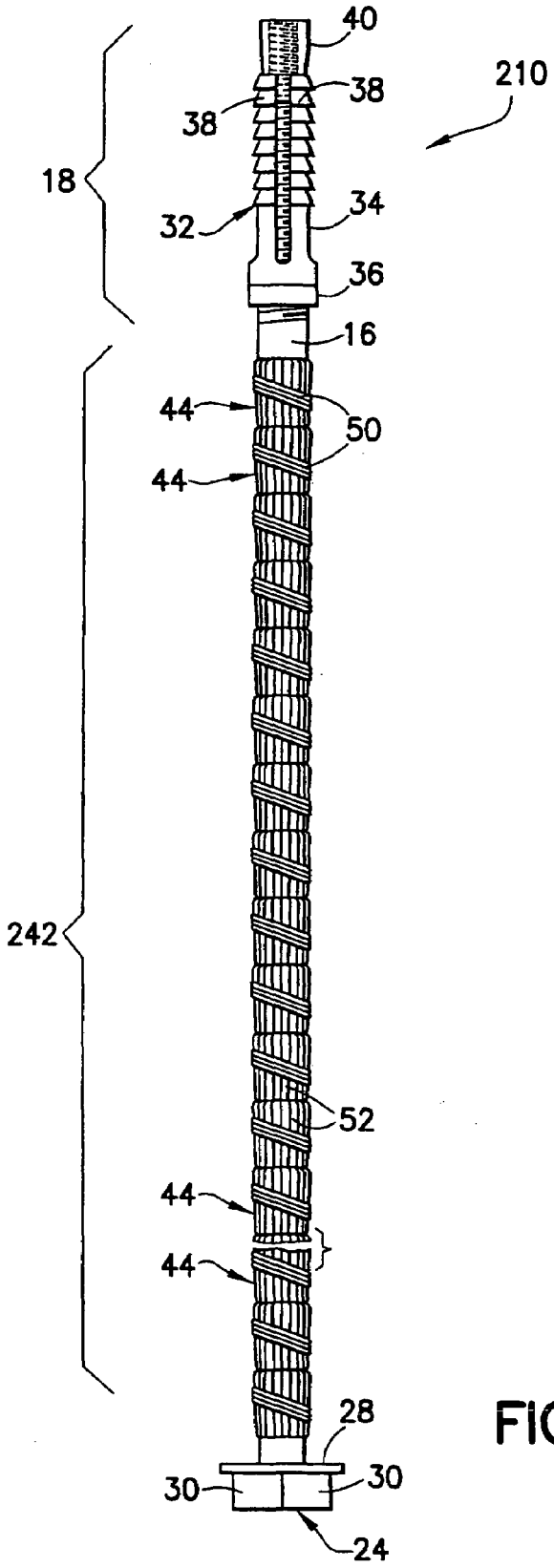
FIG. 6 is a side elevational view of a mine roof bolt having a segmented resin compression layer of the present invention, an expansion assembly, and a drive head.

In a further embodiment of the invention shown in FIG. 6, a mine roof bolt 210 includes a resin compression layer 242 having a plurality of tapered segments 44. The resin compression layer 242 extends from a position about one inch from the lower end of the expansion assembly 32 down the length of the elongated rod 16 to a position near the drive head 24. The distance between the expansion assembly 32 and the closest segment 44 may be selected based on the particular anchoring needs for the bolt 210. Likewise, the distance between the drive head 24 and the closest segment 44 may be selected to accommodate use of a bearing plate, roof mat or other roof support components as well as the particular anchoring needs for the bolt 210.

Figure 7:
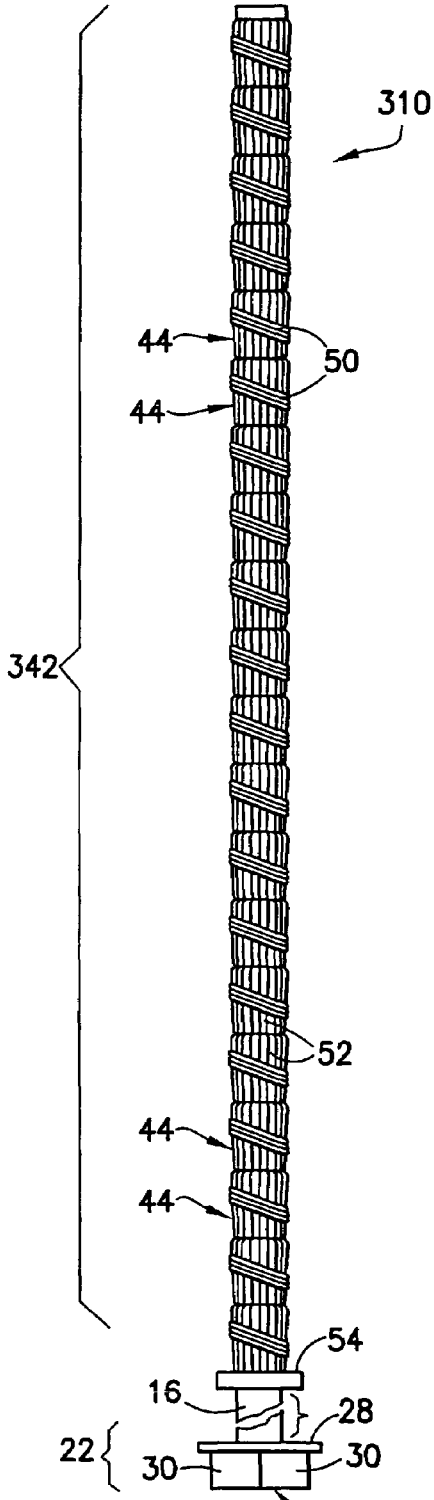
FIG. 7 is a side elevational view of a mine roof bolt having a segmented resin compression layer of the present invention, a resin retaining ring, and a drive head.
Figure 8:
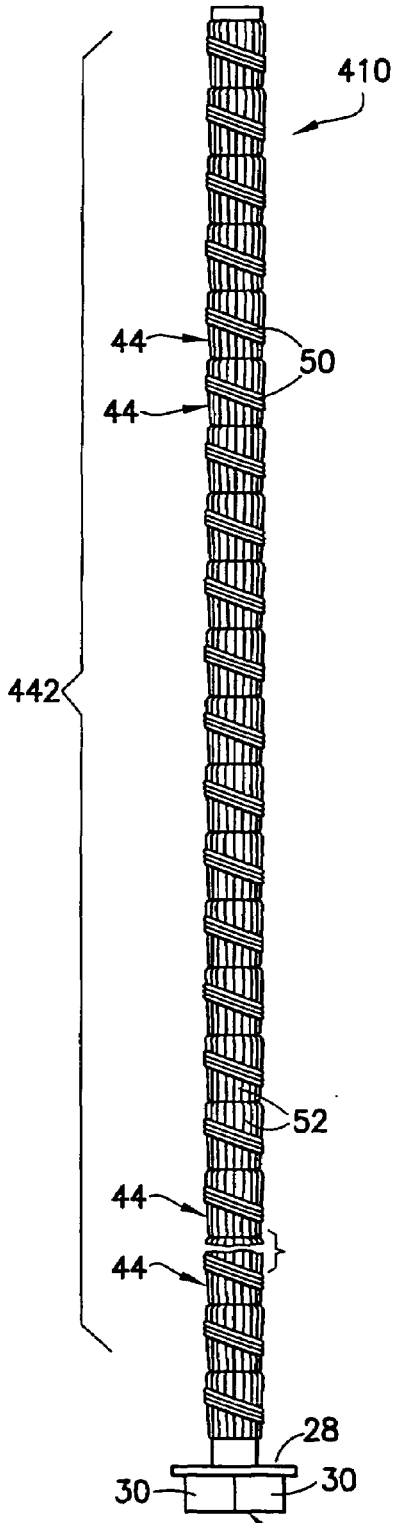
FIG. 8 is a side elevational view of a mine roof bolt having a segmented resin compression layer of the present invention and a drive head.

In another embodiment of the invention shown in FIG. 7, a mine roof bolt 310 includes a resin compression layer 342 having a plurality of tapered segments 44. The resin compression layer 342 extends from a position near the first end of the elongated rod 16 to a position intermediate the full length of the rod 16. For example, resin compression layer 342 may extend from a position near the first end of the rod 16 for about sixteen to twenty inches down the length of a four foot mine roof bolt 310. Other lengths of the resin compression layer 342 may be selected relative to the length of the bolt 310, depending on roof anchoring needs. As shown in FIG. 8, a mine roof bolt 410 can also include a resin compression layer 442 extending from a position near the first end of the elongated rod 16 down the length of the elongated rod 16 to a position near the drive head 24. The distance between the drive head 24 and closest segment 44 may be selected as described above for bolt 210.

Figure 9:
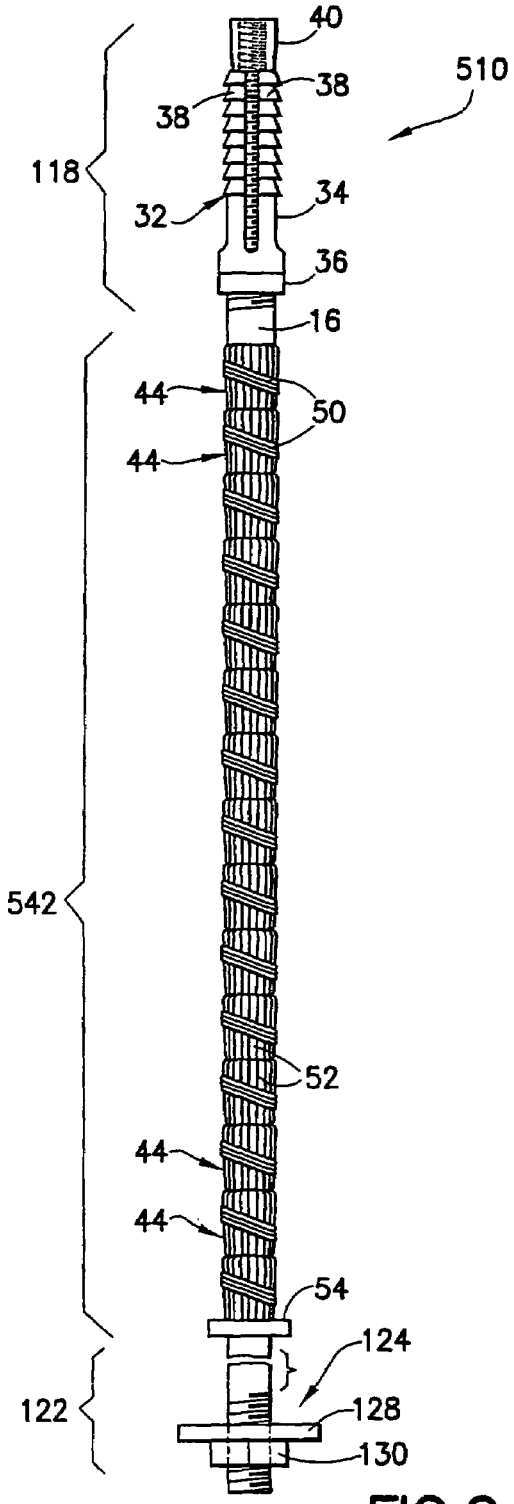
FIG. 9 is a side elevational view of a mine roof bolt having a segmented resin compression layer of the present invention, an expansion assembly, a resin retaining ring, and a drive nut.
Figure 10:
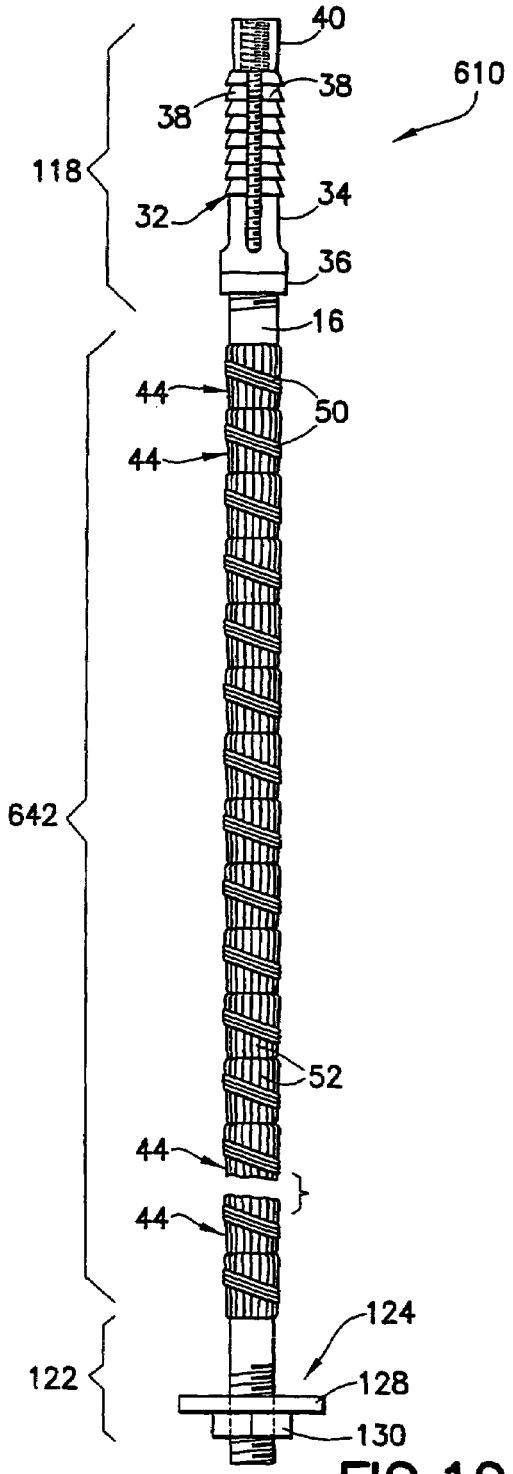
FIG. 10 is a side elevational view of a mine roof bolt having a segmented resin compression layer of the present invention, an expansion assembly, and a drive nut.

In yet another embodiment of the invention shown in FIG. 9, a mine roof bolt 510 includes an elongated rod 16 having a threaded end 118 and a threaded drive end 122. An expansion assembly 32 is threaded onto the threaded end 118 and a drive nut 124 is threaded onto the threaded drive end 122. The drive nut 124 generally includes a shoulder 128, a plurality of drive faces 130, and a threaded inner surface to receive the threaded end 118. The drive nut 124 extends into the mine passageway from the open end of the bore hole 12. The mine roof bolt 510 includes a resin compression layer 542 having a plurality of tapered segments 44. The resin compression layer 542 extends from a position near the threaded end 118 to a position intermediate the full length of the rod 16, such as being spaced about one inch from the lower end of the expansion assembly 32 for about sixteen to twenty inches down the length of a four foot mine roof bolt 510. Other lengths of the resin compression layer 542 may be selected relative to the length of the bolt 510, depending on roof anchoring needs. Also, as shown in FIG. 10, a mine roof bolt 610 utilizing the drive nut 124 on the threaded drive end 122 can have a resin compression layer 642 extending from a position near the expansion assembly 32 down the length of the elongated rod 16 to a position near the drive nut 124. The distances between the expansion assembly 32 and the segmented layer 642 and between the threaded drive head 124 and the segmented layer 642 are selected as for the corresponding distances in bolt 210.

Figure 11:
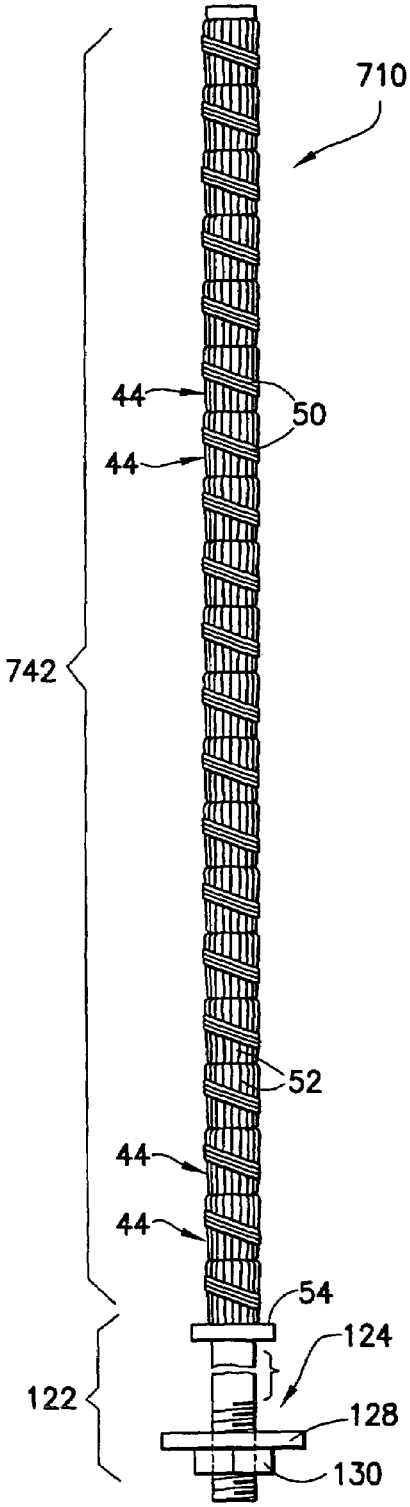
FIG. 11 is a side elevational view of a mine roof bolt having a segmented resin compression layer of the present invention, a resin retaining ring, and a drive nut.
Figure 12:
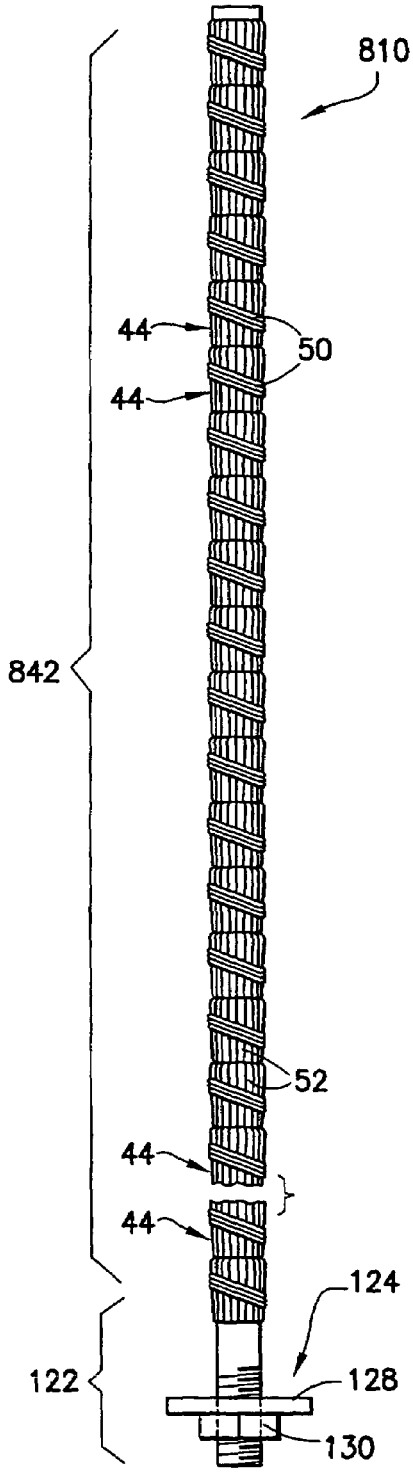
FIG. 12 is a side elevational view of a mine roof bolt having a segmented resin compression layer of the present invention and a drive nut.

In a further embodiment of the invention shown in FIG. 11, a mine roof bolt 710 includes an elongated rod 16 having a threaded end 118 and a threaded drive end 122. The mine roof bolt 710 further includes a drive nut 124 threaded onto the threaded drive end 122 and a resin compression layer 742 having a plurality of tapered segments 44. The resin compression layer 742 extends from a position at a first end of the elongated rod 16 to a position intermediate the full length of the rod 16, such as extending for about sixteen to twenty inches down the length of a four foot mine roof bolt 710. Other lengths of the resin compression layer 742 may be selected relative to the length of the bolt 710, depending on roof anchoring needs. As shown in FIG. 12, a mine roof bolt 810 can also have a resin compression layer 842 extending from a position at a first end of the elongated rod 16 down the length of the elongated rod 16 to a position near the drive nut 124. The distance between drive head 124 and segmented layer 842 is selected as for the corresponding distance in bolt 210.

Hereinafter, all references to the mine roof bolt 10, shown in FIGS. 1-3, are applicable to the mine roof bolts shown in FIGS. 5-12.

The mine roof bolt 10 of the present invention may be produced by coating the elongated rod 16 with a flowable polymer so that the coating has a thickness such as of about at least 1 mm. The polymer is allowed to solidify on the elongated rod 16 and texturing is applied to the exterior of the polymer to form the spiral threads 50 and ridges 52. The coating step may be performed by dip coating, injection molding and/or hot forging of the polymer resulting in an outer layer of a low density hard coating of the resin compression layer 42 on an inner portion of higher density material (e.g., steel) of the elongated rod 16. Because the resin compression layer 42 is typically formed from a polymer, the low density hard coating that is applied as a resin compression layer 42 increases the overall diameter of a portion of the bolt 10 with a minimal increase in weight. Hence, while realizing the weight advantages of polymers as compared to metals used in an elongated rod 16, such a composite bolt 10 can be advantageously sized to provide improved mixing of resin by creating a smaller annulus between the bolt in the location of the resin compression layer 42 and the rock 14 surrounding the bore hole 12. Likewise, with reduced annulus dimensions, less resin is required for bonding the bolt 10 within the bore hole 12 with concomitant reduction in the size and quantity of shredded resin packaging film that remains after mixing.

In one embodiment of the invention, the elongated rod 16 is a smooth rod and the polymer coating is produced by molding to create the ridges 52 and spiral threads 50. Typically, the thickness of the coating is sufficient to minimize the annulus between the resin compression layer and the bore hole wall at less than ⅛ inch or less than 1/16 inch. This reduces the overall weight of the mine roof bolt 10, particularly if the coating is a polymer of low density, such as about 2.0 g/ml or less.

Figure 13:
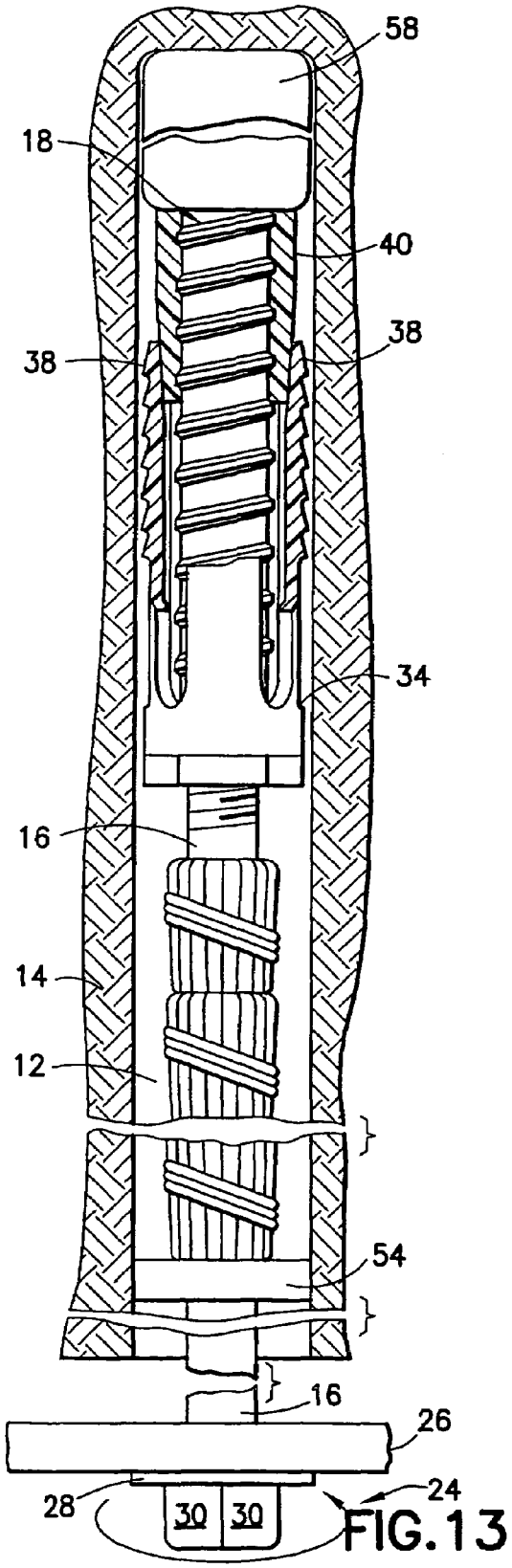
FIG. 13 is a side elevational view partially in section of one step of the method of installing one embodiment of the mine roof bolt of the present invention, illustrating the resin cartridge in position at the end of the bore hole for rupture by the expansion assembly.
Figure 14:
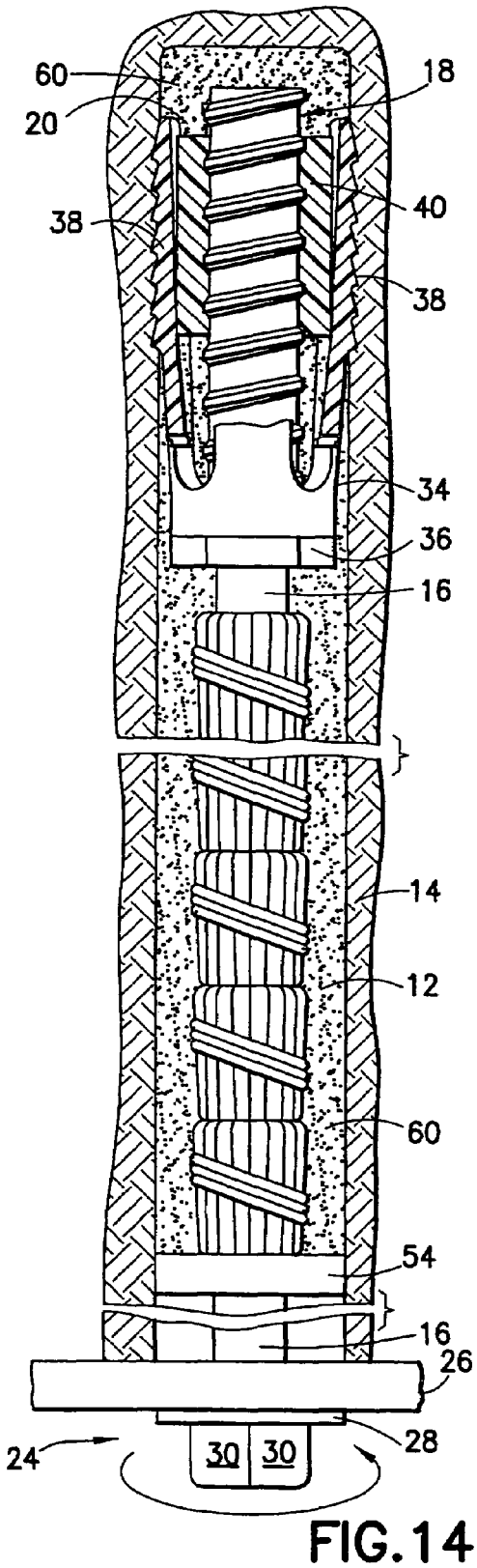
FIG. 14 is a view similar to FIG. 13, illustrating mixing of the components of the ruptured cartridge by rotation of the bolt.

Referring to FIGS. 13 and 14, in accordance with the present invention, the mine roof bolt 10 may be installed in a mine roof to provide support to the rock formation 14. In one embodiment of the method of supporting a mine roof, the mine roof bolt 10 is installed by inserting a frangible resin cartridge 58 into a bore hole 12 and inserting the mine roof bolt 10 into the bore hole 12. The mine roof bolt 10 includes an elongated rod 16 and may have a threaded end 18 onto which an expansion assembly 32 is threaded and a drive end 22 extending out of the bore hole 12. A drive end 22 is shown in FIGS. 13 and 14, but a threaded drive end 122 or other types of drive ends generally used in mine roof bolts may also be used. Drive nut 124 is threaded onto the threaded end 122 of rod 16 until the drive nut 124 cannot be advanced further along threaded end 122 when drive nut 124 abuts a stop (not shown) or the mine roof itself, thereby including tension in the bolt. Continued rotating of the drive nut 124 imparts rotation to the bolt and mixing of the resin 60. A resin compression layer 42 covers at least a portion of elongated rod 16 intermediate the drive end 22 and expansion assembly 32. When the threaded end 18 of the mine roof bolt 10 contacts the resin cartridge 58, the cartridge 58 ruptures releasing a curable resin 60. The mine roof bolt 10 is rotated about its longitudinal axis so that the resin compression layer 42 and any exposed portion of elongated rod 16 mixes the contents of the resin cartridge 58. The tapered segments 44 of the resin compression layer 42 compress the resin 60 between the exterior of the mine roof bolt 10 and the bore hole wall. An expansion assembly added onto the mine roof bolt 10 can also assist in the mixing of the contents of the resin cartridge 58. The expansion assembly 32 may include a stop mechanism that resists relative rotation between the bolt 10 and the plug 40 until a torque in excess of a predetermined torque is applied to the drive end 22 of the bolt 10. At this torque, the resistance offered by the curing resin 60 to rotation of the plug 40 fractures the stop mechanism. When the torque for breaking the stop mechanism is reached, resin mixing is complete and the plug 40 travels downwardly into the expansion shell 34. In this manner, expansion of the shell 34 is delayed until the resin 60 is mixed, but not after the resin 60 completely rigidifies in the bore hole 12. The stop mechanism includes any suitable device that restrains axial movement of the plug 40 on the bolt 10 beyond a pre-selected point on the threaded end 18 of the bolt 10, such as a breakable obstruction member (e.g., a shear pin) suitably retained within the plug 40.

Operation of those embodiments of the present invention not having an expansion assembly is similar to the operation of mine roof bolt 10 described above. An expansion assembly 32 and threaded end 18 are also shown in the embodiments of FIGS. 13 and 14, which are not used in other embodiments such as those shown in FIGS. 7, 8, 11 and 12. Shredding of the resin cartridge 58 and mixing of the resin 60 is achieved by the first end of the rod 16 bearing resin compression layer 342, 442, 742 or 842.

The resin compression layer 42 serves several functions during installation of the mine roof bolt 10 and after it is installed in a mine roof. As the bolt 10 is rotated about its longitudinal axis, the spiral threads 50 on the resin compression layer urge resin upwardly toward the blind end 20 of the bore hole 12. Retention of resin 60 at the blind end 20 of the bore hole 12 is desired to ensure good bonding between the mine roof bolt 10 and the surrounding rock 14 and to concentrate the anchoring function at the threaded end 18 of the bolt 10. Sufficient resin is required in the annulus between the mine roof bolt 10 and the bore hole wall to completely fill the annulus and allow for some of the resin 60 to fill cracks and crevices in the rock 14 to enhance the interlock between the rock 14 and the mine roof bolt 10. In addition, such bolts that are anchored by mechanical components (expansion shells), resin bonding, or both the location of the mechanical/resin anchor spaced apart from the mine roof surface creates a "point anchor" that permits tensioning of the bolt between the mechanical/resin point anchor and the mine roof surface. Retention of the resin at the upper end of the bolt is required to achieve a point anchor system that is tensionable.

The resin compression layer 42 also serves to mix the resin 60. The spiral threads 50 and the ridges 52 provide mixing surfaces to enhance mixing of the curable resin 60. The segmented arrangement of the resin compression layer 42 also provides surface disruptions that enhance mixing.

Upon application of load to the mine roof bolt, the tapered surfaces of the segments 44 create mechanical wedging forces that resist pull out of the bolt 10 from the bore holes. The thicker portion (upper end) 46 of each segment 44 compresses the resin 58 towards the bore hole wall.

In certain applications, the mine roof bolt 110 shown in FIG. 5 having a resin compression layer 142 with a terminal tapered portion 144 improves installation in a mine roof bore hole 12. The terminal tapered portion 144 provides a transition surface from the rod 16 to the resin compression layer 142, which eases insertion into a bore hole 12.

Experiments were conducted to determine the performance of the mine roof bolts of the present invention.

Figure 15:
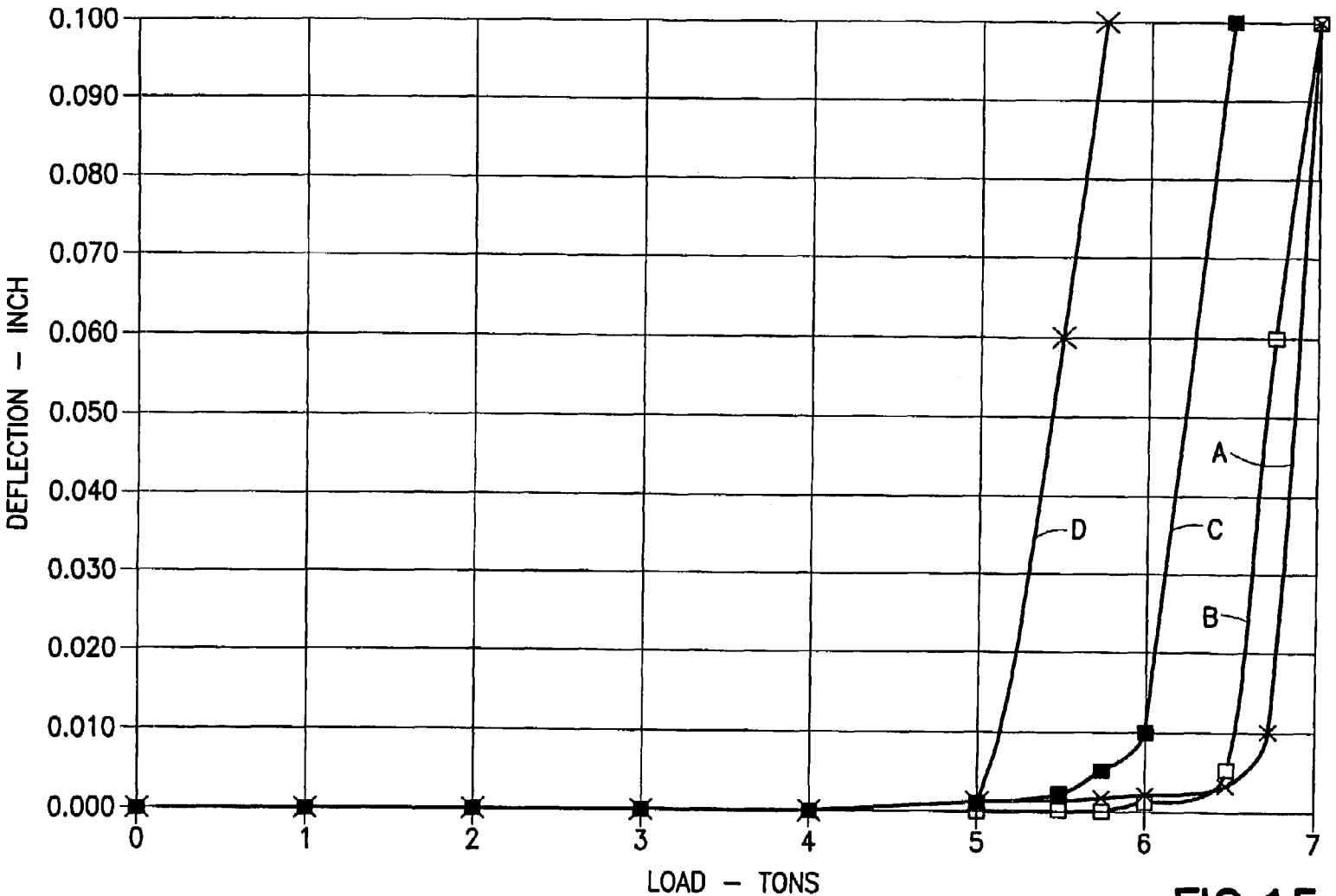
FIG. 15 is a graph of the deflection of mine roof bolts versus load for the mine roof bolt of the present invention conducted in a laboratory.

A laboratory pull test was conducted on bolts produced according to the present invention. Four bolts produced according to the present invention were used. For two of the bolts, prior to coating with the resin compression layer, the elongated rod was wiped with a cloth to remove contaminants such as oil, dirt or grease. The other two rods were not cleaned prior to coating. The bolts were installed in threaded steel bore holes and resin bonded using Insta'l 2 resin cartridges available from Jennmar Corporation of Pittsburgh, Pa. (two minute gel time, 1¼ inch diameter×13 inch long) in a 22 inch bore hole. Bolting machine thrust was set at 3000 pounds. After curing of the resin, the ends of the bolts bearing the expansion assembly were cut off and the remaining portions of the mine roof bolt were tested in a hydraulic pull apparatus to measure deflection as function of load. The test was designed to determine the load that is required to debond the resin compression layer from the elongated rod. The results of the pull test are shown in FIG. 15. Bolts A and B (cleaned bolts) exhibited respective maximum loads of 13,000 pounds and 13,500 pounds at an average unit strength of 806 pounds per inch. Bolts C and D (uncleaned) exhibited maximum loads of 12,000 pounds and 10,500 pounds, respectively, with an average unit strength of 683 pounds per inch.

The mine roof bolts of the present invention were tested for deflection in the roof of a coal mine along with bolts of the prior art. Two bolts of the present invention included a tapered portion at the end of the resin compression layer and two bolts had no tapered portion. Three bolts of the prior art (Insta'l 2 bolts available from Jennmar Corporation) were tested for comparison.

Figure 16:
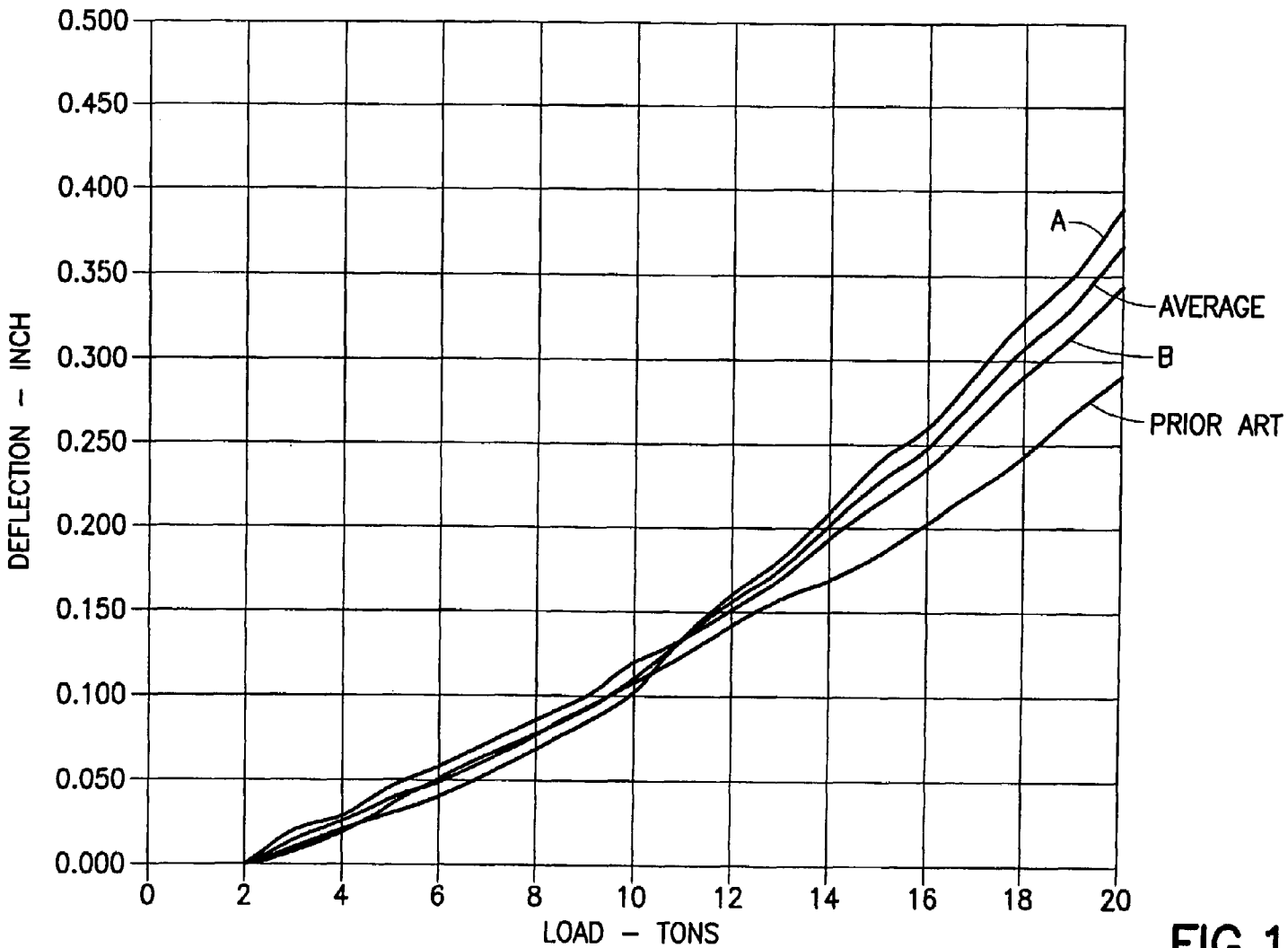
FIG. 16 is a graph similar to FIG. 15 for a mine test.

The resin used for bonding all bolts was H2 resin with one minute gel time. The mine roof bolts of the present invention were installed with resin 1¼ inch diameter×14 inch long cartridges and the prior art bolts were installed with 1¼ inch×20 inch resin cartridges. Less rotation was required to install the bolts of the present invention than the prior art bolts. The bolts having a tapered end portion were easier to insert into the bore holes than the bolts not having the tapered portion. The results of a pull test are shown in FIG. 16. For loads up to about 10-11 tons, the bolts of the present invention ("A" no tapered portion, "B" with tapered portion and "Average" thereof) and prior art bolts exhibited similar deflection. At higher loads, greater deflection was exhibited by the bolts of the present invention, which may have been due to debonding of the resin compression layer from the elongated rod.

While the present invention has been described with reference to particular embodiments of a mine roof bolt and methods associated therewith, those skilled in the art may make modifications and alterations to the present invention without departing from the spirit and scope of the invention. Accordingly, the foregoing detailed description is intended to be illustrative rather than restrictive. The invention is defined by the appended claims, and all changes to the invention that fall within the meaning and the range of equivalency of the claims are embraced within their scope.

The invention claimed is:

1. A mine roof bolt comprising:

an elongated rod having a first end and a second end; and a segmented resin compression layer covering at least a portion of said elongated rod between said first end and said second end, said segmented layer comprising a plurality of tapered segments, each segment having a first portion that is thicker than a second portion such that each segment tapers only in the direction of said second end.

2. The mine roof bolt of claim 1, further comprising an expansion assembly positioned on said first end.

3. The mine roof bolt of claim 1, wherein said second end is threaded, said second end having a drive nut positioned thereon.

4. The mine roof bolt of claim 1, wherein said second end has a drive head, wherein said drive head includes a plurality of drive faces.

5. The mine roof bolt of claim 1, wherein each segment includes a thread.

6. The mine roof bolt of claim 5, wherein each said thread is discontinuous with the thread of an adjacent segment.

7. The mine roof bolt of claim 1, wherein the surface of each said segment is textured.

8. The mine roof bolt of claim 7, wherein said texturing comprises a plurality of ridges extending between said first and second portions.

9. The mine roof bolt of claim 1, wherein said segmented layer further comprises a tapered portion extending and tapering from a first portion of a terminal segment to a position spaced from said first end.

10. The mine roof bolt of claim 1, further comprising a resin compression ring adjacent an end of said segmented layer proximal to said second end.

11. The mine roof bolt of claim 1, wherein at least the portion of said elongated bar covered by said segmented layer is smooth.

12. The mine roof bolt of claim 1, wherein said segmented layer is polymeric.

13. In a mine roof bolt system comprising (i) a mine roof bolt comprising an elongated rod having a first end and a second end; and (ii) curable resin for securing the mine roof bolt in a bore hole, the improvement comprising:

a segmented resin compression layer covering a portion of the elongated rod between the first end and the second end of the elongated rod, wherein said segmented resin compression layer comprises a plurality of tapered segments, each segment having a first portion that is thicker than a second portion such that each segment tapers only in the direction towards said second end.

14. The mine roof bolt system of claim 13, wherein the resin is compressed between the thicker first portion of the compression layer and a bore hole wall.

15. A method of installing a mine roof bolt in a mine roof bore hole comprising the steps of:

inserting a frangible curable resin cartridge into the bore hole;

inserting a mine roof bolt in the bore hole, the mine roof bolt comprising an elongated rod having (i) a first end; (ii) a second end extending out of the bore hole; and (iii) a segmented resin compression layer having segments tapering only in the direction of the second end covering a portion of the elongated rod intermediate the second end and the first end;

rupturing the resin cartridge; and rotating the mine roof bolt such that the resin compression layer mixes contents of the resin cartridge and compresses the resin between the resin compression layer and the bore hole wall.

16. The method of claim 15, wherein the surface of each segment includes a spiral thread, whereby rotation of the mine roof bolt urges the resin toward the first end.

17. A method of making a mine roof bolt comprising the steps, in any order, of:

providing an elongated rod;

applying a segmented layer to a portion of the rod intermediate a first end and a second end; and attaching a drive head or a drive nut to the second end of the rod, the segmented layer comprising tapered segments tapering only in a direction towards the second end.

18. The method of claim 17, wherein the segmented layer is applied to the rod by injection molding.

19. The method of claim 18, wherein the segmented layer is polymeric and the rod is metallic.

20. The method of claim 17, further comprising the step of threading an expansion assembly on the first end of the elongated rod.

* * * * *

UNITED STATES PATENT AND TRADEMARK OFFICE

CERTIFICATE OF CORRECTION

PATENT NO. : 7,296,950 B1
APPLICATION NO. : 11/474006
DATED : November 20, 2007
INVENTOR(S) : Stankus et al.

It is certified that error appears in the above-identified patent and that said Letters Patent is hereby corrected as shown below:

On the Title Page: See Item (75) Inventors: "John C. Stankus, Canonsburg, PA (US); John G. Oldsen, Butler, PA (US)" should read
-- John C. Stankus, Canonsburg, PA (US); John G. Oldsen, Butler, PA (US); Walter J. Simmons, Martinsburg, WV (US); and W. Neal Simmons, Durham, NC (US) --

Signed and Sealed this

Twentieth Day of May, 2008

JON W. DUDAS
*Director of the United States Patent and Trademark Office*